US005775587A

United States Patent [19]

Davis

[11] Patent Number: 5,775,587

[45] Date of Patent: Jul. 7, 1998

[54] PORTABLE HANDHELD DRINKING WATER FOUNTAIN

[76] Inventor: Russell A. Davis, 5250 W. Mill Rd., Broadview Heights, Ohio 44147

[21] Appl. No.: 638,969

[22] Filed: Apr. 25, 1996

Related U.S. Application Data

[60] Provisional application No. 60/000,247 Jun. 15, 1995.

[51] Int. Cl. [6] ..... E03B 9/20

[52] U.S. Cl. ..... 239/25

[58] Field of Search ..... 239/24, 25, 390, 239/31

[56] References Cited

U.S. PATENT DOCUMENTS

| | | | |
|---|---|---|---|
| 1,028,142 | 6/1912 | Seaman . | |
| 1,062,695 | 5/1913 | Cornelius . | |
| 1,081,718 | 12/1913 | Brown | 239/31 X |
| 1,162,644 | 11/1915 | Parlett . | |
| 1,366,150 | 1/1921 | Askin . | |
| 1,469,771 | 10/1923 | Allen . | |
| 1,715,875 | 9/1929 | Taylor | 239/31 X |
| 2,171,471 | 8/1939 | Brunetti . | |
| 2,320,536 | 6/1943 | Mead | 239/25 |
| 2,366,427 | 1/1945 | Scheid . | |
| 2,392,512 | 1/1946 | Thompson | 239/25 |
| 2,524,956 | 10/1950 | Brunetti . | |
| 2,579,769 | 12/1951 | Tyler . | |
| 2,661,237 | 12/1953 | Swartz . | |
| 2,747,930 | 5/1956 | Hyde . | |
| 2,841,799 | 7/1958 | Traynor . | |
| 2,956,749 | 10/1960 | Perry . | |
| 2,994,481 | 8/1961 | Blumberg | 239/25 |
| 3,101,174 | 8/1963 | Loveland . | |
| 3,131,868 | 5/1964 | Coleman | 239/390 X |
| 3,133,701 | 5/1964 | McClenahan . | |
| 3,338,522 | 8/1967 | McGee | 239/24 |
| 3,443,753 | 5/1969 | McDonnell . | |
| 3,462,080 | 8/1969 | Howard et al. . | |
| 3,642,031 | 2/1972 | Wright | 239/24 X |
| 3,856,203 | 12/1974 | Clark . | |
| 4,389,016 | 6/1983 | Gibbs . | |
| 4,934,597 | 6/1990 | Crutcher . | |
| 5,257,647 | 11/1993 | Wilhite . | |
| 5,337,956 | 8/1994 | Crutcher . | |

*Primary Examiner*—Kevin Weldon

*Attorney, Agent, or Firm*—Pearne, Gordon, McCoy and Granger LLP

[57] ABSTRACT

This invention is a handheld drinking water device which converts a standardized water faucet to a laminar fountain, and more particularly to a device that accommodates and seals with a faucet aerator to convert a flow of water from a faucet into a drinking fountain. The purpose of the drinking devices is to provide a simple and quick method of obtaining a sanitary drink of water from a kitchen or bathroom sink faucet. This novel handheld drinking water device redirects the downward flow of water into a controlled stream of water so that it performs as a sanitary drinking fountain.

18 Claims, 5 Drawing Sheets

PORTABLE HANDHELD DRINKING WATER FOUNTAIN

This application claims the benefit of U.S. provisional application No. 60/000,247, filed Jun. 15, 1995.

REFERENCE TO PREVIOUSLY FILED APPLICATIONS

Your applicant makes reference to the disclosure documents and Provisional Application heretofore filed by him, as follows:

1) Disclosure Document No. 368832, submitted 01/20/95;

2) Disclosure Document No. 377526, submitted 05/19/95;

3) Provisional Patent Application 190 60/000,247, filed 06/15/95;

4) Disclosure Document No. 391640, filed 01/21/96;

5) Disclosure Document No. 391159, filed 01/23/96; and,

6) Disclosure Document No. 393203, filed 02/01/96.

FIELD OF INVENTION

This invention relates to a portable, handheld drinking water fountain appurtenance that can be used as an accessory object to standardized water faucets, and more particularly as an accessory object that is an adjunct to convert a flow of water from a faucet into a drinking fountain. This novel handheld drinking water device redirects the downward flow of water into a laminar controlled stream of water so that it performs as a sanitary drinking fountain.

BACKGROUND OF THE INVENTION

It is a well-known fact that sharing a common water glass in a home is a means of spreading a cold or flu among family members. In recognizing this fact, there have been several patented inventions that have disclosed drinking water devices that offer a sanitary fountain attachment that can provide an alternative to the shared household water glass.

U.S. Pat. No. 4,934,597, granted Jun. 19, 1990, to W. C. Crutcher, discloses a plastic attachment to a faucet. Its tubular body is adapted for attachment to the discharge end of a water faucet.

U.S. Pat. No. 4,389,016, granted Jun. 21, 1983, to J. T. Gibbs, teaches a drinking fountain attachment that uses a paraboloidal deflector to redirect a stream of water exiting a water faucet into a gentle arc that is convenient to drink from.

U.S. Pat. No. 3,462,080, granted Aug. 19, 1969, to J. S. Howard, discloses apparatus connectable to a water faucet for permitting its selective use as a drinking fountain.

U.S. Pat. No. 2,366,427, granted Jan. 2, 1945, to A. A. Scheid, discloses a portable sanitary drinking fountain which diverts the exit flow of a faucet through an upstanding discharge nozzle.

U.S. Pat. No. 1,469,771, granted Oct. 9, 1923, to W. B. Allen, discloses a portable drinking fountain bubbler which converts a downward directed liquid stream into a bubbler form by passing through a plurality of perforations.

U.S. Pat. No. 1,028,142, granted Jun. 4, 1912, to A. D. Seaman, discloses a sanitary drinking device that attaches to water spigot using a flaring mouth opening made of a resilient rubber. When not in use, it can be conveniently carried about in the pocket of the user.

Many of the above referenced prior art disclose sanitary drinking devices that are permanently attached to existing water faucets. These devices are inconvenient to use for in order to reconvert the water faucet in its original form, the user must first remove or disengage the attachable drinking fountain. These early designs used water tight seals that mated with the earlier designed existing water faucets. Faucets styled in this manner are seldom found in use in the home today. In today's technologies, a majority of the faucets in use in the home today are equipped with aerators attached to the exit end of the faucet. Because of the plethora of varied sizes and shapes of aerators, the inlet designs of the previously designed devices preclude the necessary creation of a water tight seal around the edge of the aerator.

There are many problems that exist in using the various apparatuses described. Many of these devices require permanent attachment to the water faucet. Other devices require two hands to operate the device; some, only one hand. Many of these devices can harbor harmful bacteria in the sharp crevices within the formed devices.

What is needed is a small, lightweight, portable sanitary drinking water fountain that can be used as an adjunct accessory to existing water faucets. In this regard, this invention fulfills this need.

SUMMARY OF THE INVENTION

The present invention finds particular application in the home and office as a portable sanitary drinking fountain that is an appurtenance to existing water faucets.

This novel portable drinking fountain accessory in its preferred embodiment is comprised of a globular shaped ceramic, which has an upward directed integral spout. The upper opening has an upper gasketed insert made of a resilient elastomeric formulation. At the end of the spout is an exit nozzle insert that is shaped to produce a laminar flow of fluid.

In using the present invention of a drinking device, the water faucet is first turned on to a low flow rate of discharge. With the drinking device held in one hand, the recessed angled inclined plane of the insert seal is conveniently held against the aerator outlet in the faucet. With a slight pressure exerted by the hand against the aerator, a watertight seal is formed, thereby forcing the water through an orifice. The water is directed through the inlet down into the cavity of the main body element and out at an upward angle through the discharge nozzle, creating a stream of water that is suitable for one to take a drink of water. The stream of water is dispensed upwardly in a smooth laminar flow of water comparable to that found in public water fountains.

The handheld globular shaped drinking fountain is made of a ceramic material, such as porcelain, stoneware or earthenware, which is fired with a food-safe lead-free glaze. Because there are no sharp corners or recesses that can trap and harbor harmful bacteria, the device can be maintained in a sanitary condition with only periodic cleaning.

Removing the insert seal is easily performed by prying out the insert with one's fingers. If more extraction force is needed, a paring knife can be used to pry it out gently. The insert can be rotated and pressed back into the main element with the beveled recess being in a more favorable position relative to the angle of water being discharged from the faucet. If the angle of the water being discharged from the orifice is not convenient to take a drink of water, the insert seal can be removed and rotated so that its angled inclined plane tilts the fountain into a new position. It is then reinstalled in the cavity of the main element.

By manually regulating the water pressure, the resulting flow rate out of the faucet will increase or decrease the height of the arc that is formed by the stream of water.

After one is finished taking a drink of water, the device is inverted, allowing the water remaining in the cavity to empty through the inlet orifice into the sink. When the device is not in use, it may be stored on the sink top in its inverted position while resting upon the insert seal.

This drinking device fulfills the need for a sanitary drinking fountain that is simple and easy to operate for use in the home, office or factory. It is simple in design and relatively inexpensive to manufacture, since it is made from commercially available materials that have appealing colors.

The advantage of using this drinking device over using the common drinking glass is that it provides sanitary use, is easy for anyone to use, and eliminates the need for washing glasses or the disposing of paper cups.

A further advantage of this drinking device is that there is no installation or special installation tools needed before using this fountain. It is completely portable and is interchangeable with a variety of standard water faucets, without the need of further adjustment.

It is an object of this invention to provide for a portable faucet fountain that is compatible with all domestic water faucets that use an aeration device.

It is another object of this invention to provide for a portable faucet fountain that is sanitary in use and is free from harmful bacteria.

It is still another object of this invention to provide for a portable faucet fountain where the user can adjust the discharge angle of the water flowing from the nozzle of the faucet fountain drinking device.

Yet it is another object of this invention to provide for a portable faucet fountain that is easily held in the palm of one hand and is relatively simple and convenient to use.

Lastly, it is another object of this invention to provide for a portable faucet fountain that is ergonomically designed and is less expensive to manufacture.

BRIEF DESCRIPTION OF THE DRAWINGS

The invention is diagrammatically illustrated in the following drawings attached herein.

DESCRIPTION OF THE PREFERRED EMBODIMENTS

The purpose of this novel drinking device is to provide a simple and quick method of obtaining a sanitary drink of water from a kitchen or bathroom sink faucet, thereby eliminating the use of shared water glasses, paper cups and the like.

Figure 1A:
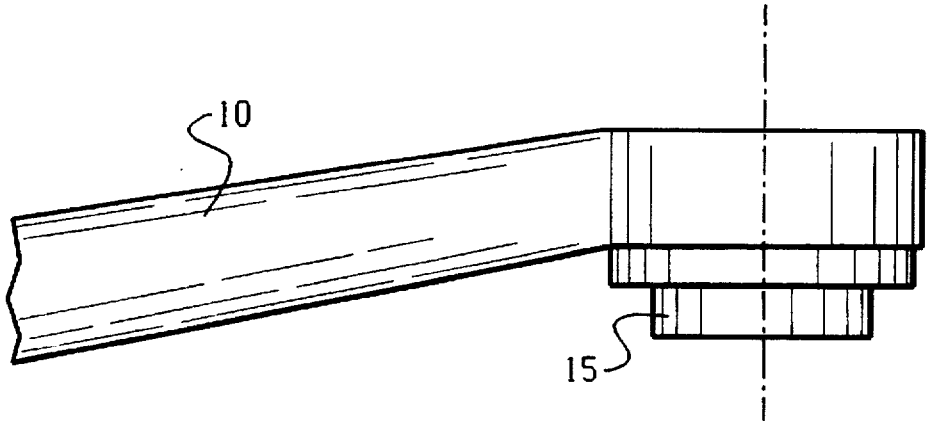
FIG. 1*a* is side elevation of a typical water faucet, shown in a horizontal position, where the downward stream of water flowing from it is mutually perpendicular to its aeration device.

FIG. 1*a* depicts a typical water faucet 10 shown in a horizontal position. Attached to its exit orifice is an aeration device 15. The flow of water exiting the faucet is directed in a downward direction that is mutually perpendicular to the aeration device.

Figure 1B:
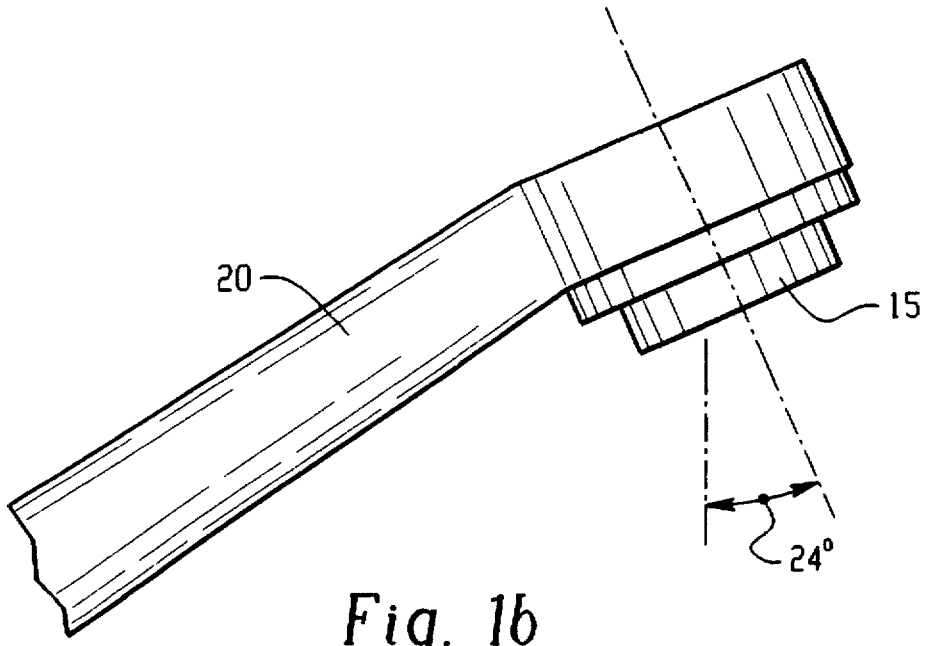
FIG. 1*b* is a side elevation of a similar water faucet that is shown in an elevated position. The exit position is typically 24 degrees from the vertical centerline and can range between 0 to 24 degrees from its centerline.

FIG. 1*b* shows another styled available water faucet 20 that is inclined upwards at approximately 24 degrees to allow various cooking utensils to be easily placed beneath the faucet. In this type of water faucet, the exit flow stream is directed downward at an angle of approximately 24 degrees from its installed vertical centerline.

Figure 2:
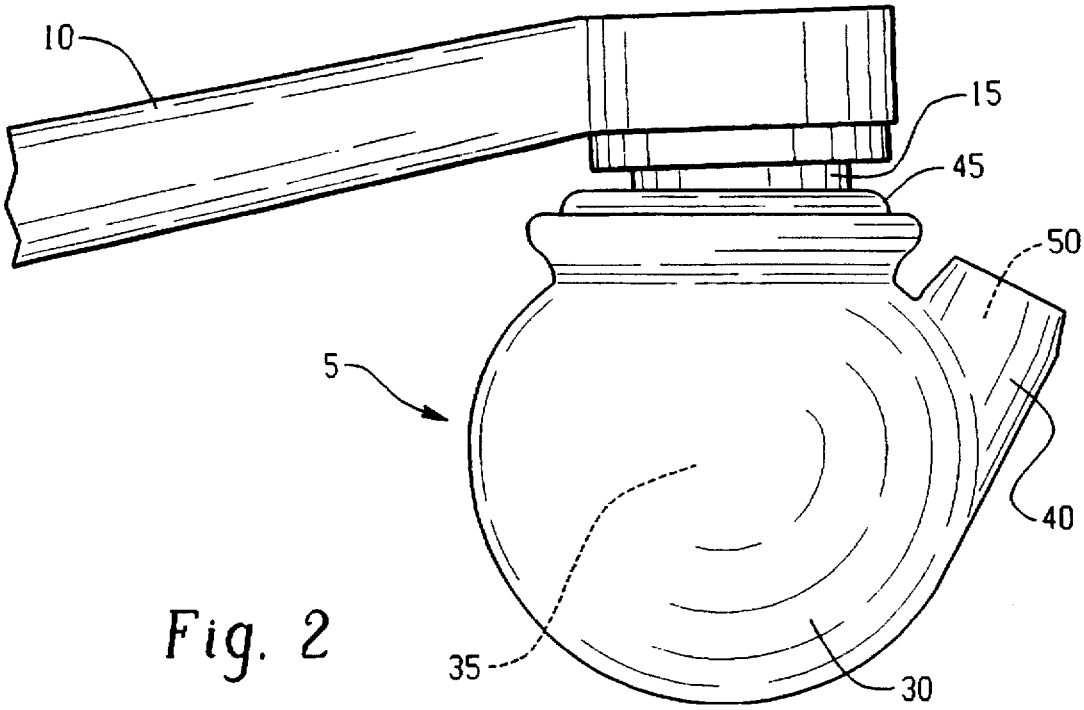
FIG. 2 is a side elevation of a typical water faucet with the portable handheld drinking fountain shown in its fully engaged position at the exit aerator of the water faucet.

Turning now to FIG. 2, the invention 5 shown with the portable handheld drinking fountain body 30 held in close contact with the aerator output 15.

Figure 3:
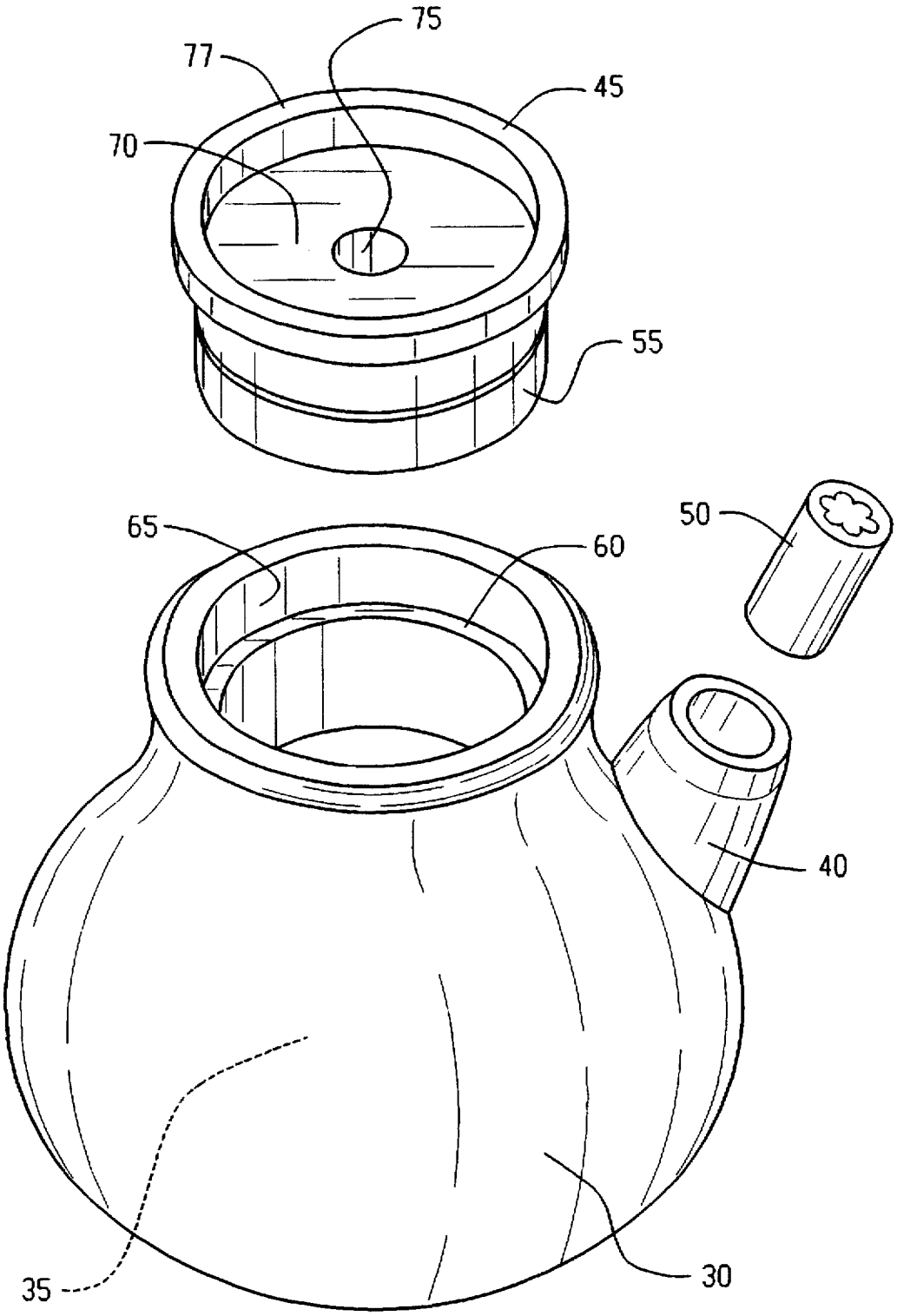
FIG. 3 is an exploded perspective drawing of the portable handheld drinking fountain. Three main elements are illustrated. They are: the body which collects the flow of water in its cavity, and directs an exit flow of water upwards, a resilient angled inclined plane entrance orifice, and an exit nozzle to control the laminar flow.

As shown in FIG. 3, this novel portable handheld drinking fountain accessory 30 in its preferred embodiment is comprised of a globular shaped ceramic stoneware 35, which has an upward directed integral spout 40. The upper opening 65 is designed to receive an upper gasketed insert 45 made of a resilient elastomeric formulation. This upper gasketed insert is formed with an angled inclined plane surface that comes in contact with an aerator, when in use. At the end of the spout is an exit nozzle insert 50, that is internally shaped to produce a laminar flow of fluid.

In using the present invention, which discloses a portable handheld ceramic drinking fountain device, the water faucet 10 is first turned on to provide a relatively low rate of flow of water. With the drinking device held in one hand, the insert seal 45 is lightly held against the aerator 15 found at the exit of the faucet. The water is directed through the orifice 75 in the inlet seal 45, down into the cavity of the main body element 35 and out through the discharge nozzle 40 and laminar flow nozzle insert 50, upwardly directed into the atmosphere, while dispensing a smooth laminar flow of water comparable to that as obtained from a public water fountain. After use, the drinking fountain device may be placed in an inverted position on the sink top, while resting upon its insert seal.

FIG. 3 is an exploded perspective drawing of the portable handheld drinking fountain 30. Three main elements are illustrated. They are: a resilient entrance orifice 45, a body which collects the flow of water in its cavity 35, and a laminar exit flow insert 50. In typical use the exit flow of water is directed upwards through an exit nozzle 40, in conjunction with a nozzle insert 50, to control the laminar flow of the fluid media. As the fluid exits through the nozzle, it flows in a gentle arc that allows the user to sip the water at the crest of the arc.

The insert seal 45 is a mating assembly which adjusts the faucet fountain to create a desired fountain from any faucet. The insert seal 45 is made from a resilient material, such as a low durometer thermoplastic elastomer. It has an angled flat-surfaced inclined plane aerator receiving area 70 with the water inlet orifice shown at 75 and upstanding seal ring 77 which surrounds the receiving area. The insert further contains a annular ridge 55 which rests on the retaining ridge or shoulder, at 60 when the insert seal is placed into the opening at 65 in the main body element 35. Because the insert seal is slightly oversize and because of the resiliency of this material, the insert seal will remain in place.

When first put in use, the device may require an adjustment to the insert seal to obtain optimum performance. Adjustment of the insert seal 45 is done by prying out the insert with the fingers. The insert seal is then rotated and pressed back into the main element with the bevel positioned more favorable relative to the angle of water being discharged from the faucet.

Domestic water faucets discharge water into the sink at a predetermined angle when manufactured. This angle may vary between 0 to 24 degrees as shown in FIGS. 1*a* and 1*b*.

Therefore, the purpose of the angled inclined plane surface in the seal insert is to compensate for the style of the faucet by removing the insert, rotating it and reinserting it into the main body.

Figure 4:
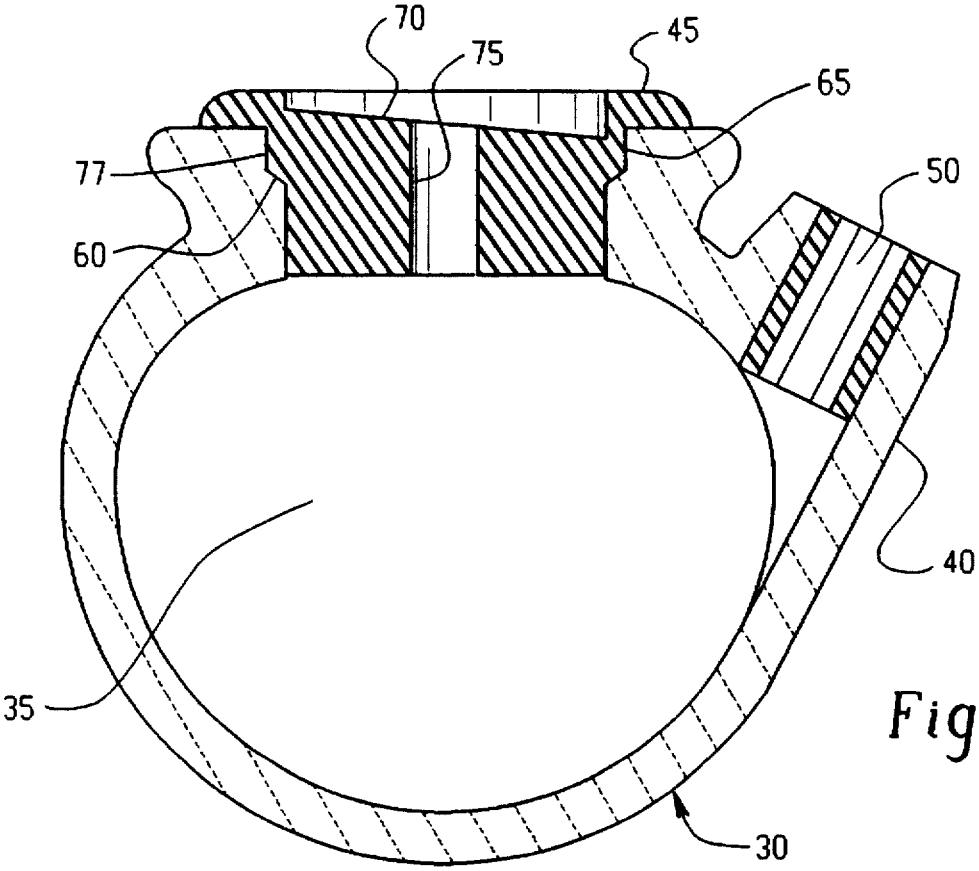
FIG. 4 is a cross-sectional view of the handheld drinking fountain which shows a resilient angled inclined plane resilient entrance orifice and a resilient shaped exit nozzle in their respective installed positions.

The embodiment illustrated in FIG. 4, shows a cross-sectional view of the completely assembled drinking device 30. Assembly is performed by pressing the nozzle insert 50 and insert seal 45 into the main body element 35 by hand. The opening or orifice in the insert seal 50, is identified by 75.

Figure 5A:
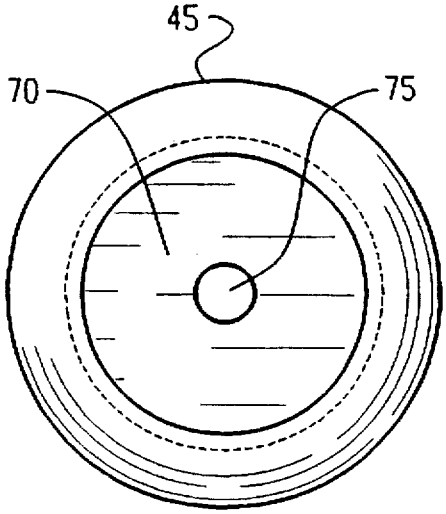
FIG. 5*a* is a top elevation of the preferred resilient angled inclined plane entrance orifice.
Figure 5B:
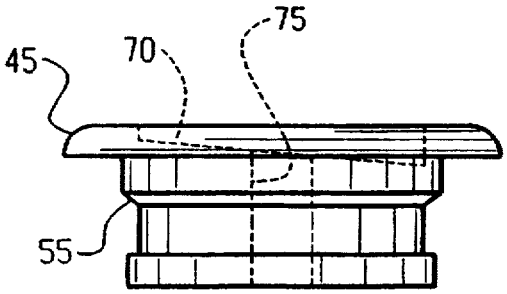
FIG. 5*b* is a side elevation of the preferred resilient angled inclined plane entrance orifice.

FIGS. 5*a* and 5*b* show the top and side views of the entrance insert seal 45. This entrance insert seal is made of a pliable low durometer material, such as a thermoplastic elastomer. It is designed with an angled inclined plane flat portion 70, that has the water inlet orifice at 75 centered within this area. It has an annular ridge 55 which comes in contact with the retaining ridge 60 in the main body element to prevent the insert seal from slipping down into the cavity when placed against the aerator in the end of the water faucet 15.

Figure 6A:
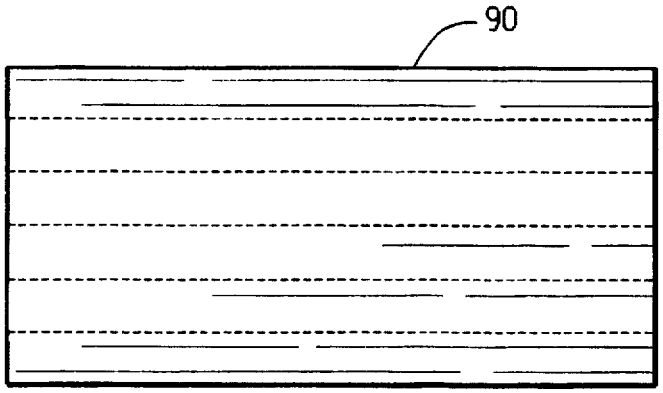
FIG. 6*a* is a side elevation of the preferred multi-channeled resilient laminar flow exit nozzle.
Figure 6B:
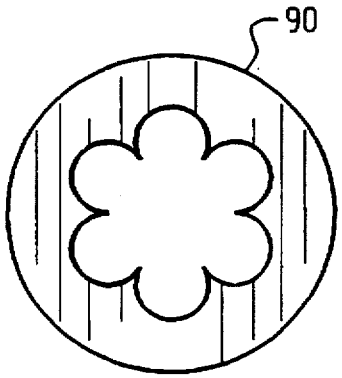
FIG. 6*b* is an end view of the preferred multi-channeled resilient laminar flow exit nozzle.

In the preferred embodiment, a fluted exit nozzle 90 is shown in FIGS. 6*a* and 6*b*. Ideally, it is made of the same material as the insert seal. It is cylindrical in shape, with the inner wall of the nozzle being fluted uniformly throughout the length of the ID The depth and curvature of the flutes, commensurate with a plurality of flutes produces a smooth laminar stream of water for the portable drinking device. This nozzle is designed to be made by extrusion, which is quick, simple and inexpensive to manufacture.

Figure 7A:
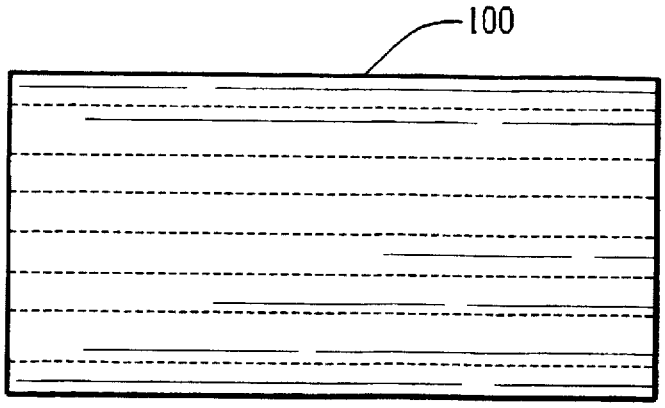
FIG. 7*a* is a side elevation of an alternatively designed resilient laminar flow exit nozzle.
Figure 7B:
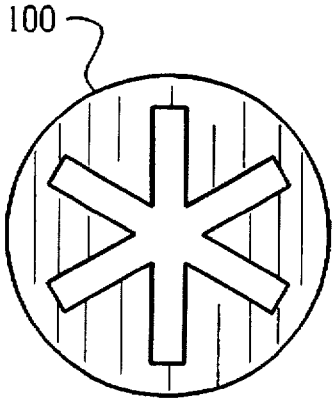
FIG. 7*b* is an end view of an alternatively designed resilient laminar flow exit nozzle.

An alternately designed exit nozzle is shown in FIGS. 7*a* and 7*b*. This internally slotted nozzle 100 is shaped cylindrically, having a plurality of slots arranged to converge at the center of the nozzle. The outer surface of the nozzle is dimensionally uniform throughout its length and diameter. The arrangement of interconnected slots perform to control a turbulent flow of water entering the nozzle into a laminar flow stream of water upon exiting the nozzle into the atmosphere.

All of the above referenced embodiments of exit flow nozzle are designed to produce a smooth stream of water in a relatively short distance.

Figure 8A:
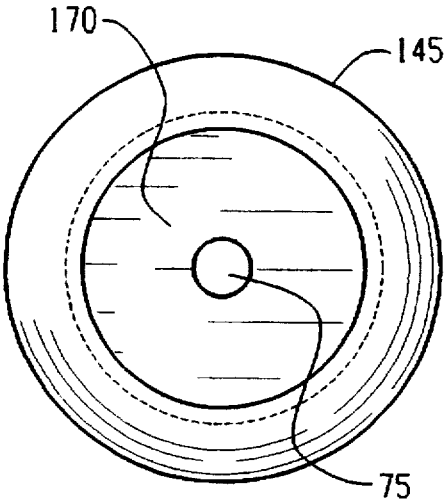
FIG. 8*a* is a top elevation of an alternate resilient parallel plane entrance orifice.
Figure 8B:
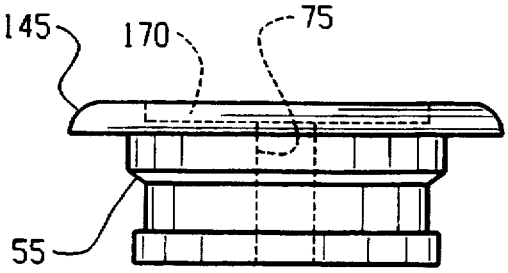
FIG. 8*b* is a side elevation of an alternate resilient parallel plane entrance orifice.

In an alternate embodiment, FIGS. 8*a* and 8*b* show insert seal 145. It has an flat-surfaced parallel plane aerator receiving area 170 with the water inlet orifice shown at 75 and upstanding seal ring 77 which surrounds the receiving area. The insert further contains a annular ridge 55 which rests on the retaining ridge at 60 when the insert seal is placed into the opening at 65 in the main body element 35.

After one is finished getting a drink of water, the drinking device is inverted, allowing the water remaining in the cavity to empty through the inlet into the sink. When it is not in use, it may be placed on the sink top in the inverted position, while resting upon its seal 45.

These insert seals and exit nozzles can be made of resilient or pliable plastic or rubber, such as polyvinyl chloride (PVC), tygon, silicone rubber and the like. Regarding the handheld fountain, there are several other materials that can be used in the manufacture of this device. These materials include rigid plastics, such as acrylic, melamine, polyester, phenolic and the like.

It should be obvious to those skilled in the art that other substitutions in materials or alterations in dimensions can be made without departing from the spirit of the invention.

DETAILED CONSTRUCTION AND ASSEMBLY

Bare Mold Assembly:

The bare mold includes a plaster mold and a rubber band only.

Complete Mold Assembly:

A complete mold assembly includes the following steps:

One plaster mold with a rubber band.

A "pouring insert" and a "nozzle insert" with a 5/16" by ½" ring.

A small amount of black 3M strip caulk.

FAUCET FOUNTAIN CASTING PROCEDURE USING SLIP CASTING

The two plaster mold halves are joined by using a rubber band. The pouring insert is then placed into the mold. A sharp pencil is used to mark a line around the insert found at the top of the mold. It may be observed that the insert wiggles back and forth slightly. This small amount of play is normal. Separate the mold and lay the insert in the half of the mold that has the pencil line marked at the top of the mold. Note that the depth should be approximately ¼ inch. If it is not deep enough, reassemble the mold after sanding or scraping a very small amount of plaster from the inside of the mold at a point where the insert makes contact with the plaster. This usually occurs along the parting line. Reassemble the mold halves with a rubber band, and draw a new pencil line around the insert. Again check the insert depth. Repeat if necessary until a depth of ¼ of an inch is reached. If it is too deep, add a small piece of tape around the insert to space it up. If there is more than one mold assembly, place a number on the pouring insert and mold to ensure that they remain together.

Parting Agent

The use of a parting agent on the inserts will assist in withdrawing them from the greenware. Two parts of mineral oil mixed in one part Vaseline works best. This mixture is water resistant and will not affect the greenware. Using a brush, apply the parting agent to the lower half of the pouring insert and nozzle insert. A thin coating of release is usually sufficient. Experience dictates the amount to apply. The correct amount of parting agent will allow the inserts to demold easily and cleanly from the greenware. Added amounts of the parting agent may be reapplied each time they are used.

Mold Assembly

To assemble the mold, place one half of the mold on the work table and lay the nozzle insert in place. Extend the insert approximately 1 inch into the cavity. The O-ring should touch the plaster. The O-ring serves as a depth gauge and prevents the insert from sliding into the mold. Join the mold halves and place them in an upright position. Install the rubber band while ensuring that the mold halves are maintained tightly together. Check the amount of play of the nozzle insert by wiggling it. There will be a small amount of play. However, this is usually not a problem. If it is, wrap a single layer of cellophane tape around the insert. This will center the insert. Place the pouring insert into the mold. Now, take two small pieces of black strip caulk and press them firmly on either side of the insert. The purpose of using a strip caulk is to keep the insert into the mold when the mold is inverted. Enough should be used to hold the insert in place. Strip caulk, when used, is not a throwaway item. It does not dry out and can be used repeatedly.

Pouring Slip

Slip is poured through insert until the insert is half full. The slip should stay in the mold long enough to develop approximately a ¼ inch wall thickness. Pour the slip out and place mold inverted on an elevated surface. Cans or a wood form will work best. Do not place the mold on the insert. Air must circulate through the insert to dry the clay. The excess slip inside the mold will drain down around the inserts creating a uniform wall. Note that the type of slip used will determine how long the slip should stay inside the mold. Experience has shown with various slip that to form a 7/32" to ¼" wall thickness, 30 to 75 minutes should be allowed before returning.

Demolding

After approximately 24 hours, the mold should be turned upright and the inserts removed. These inserts should leave a smooth impression in the greenware. If they are difficult to remove, they may require that more parting agent be used. By gently rotating them, they will be easier to release and remove. Next:

Demold greenware and let dry.

Check nozzle opening and remove any of the clay obstruction.

Check the wall thickness in the greenware. This may be a little difficult. Sacrificing a unit by cutting it apart and measuring it, is about the only way this can be accomplished.

A uniform wall thickness is very important. A faucet fountain will be handled daily. It should be strong. Also the smaller the cavity the quicker it will fill and drain water. 7/32" to ¼" is the correct dimension.

Greenware

When the greenware is dry, measure the recess; it should be ¼ inch or slightly less. If not, adjust the insert depth in the mold as previously described. This should give about 3/16 of an inch depth for the insert seal when the piece is completed for assembly. If the recess in the finished piece is slightly deeper than 3/16 of an inch, the piece is still usable. If it is too shallow, the insert seal will not fit deep enough. Then, fire greenware at cone 2 for hardness and dimensional accuracy. The bisque must shrink enough to hold the insert in place. Only food-safe glazes should be used.

Stilt Mark

The impression left by the stilt after firing the glaze, must be permanently sealed to prevent water from entering the bisque. Fingernail polish thinned with acetone or lacquer thinner will soak in and do the job. A tooth pick makes a good applicator. When dry, place a small drop of water over the stilt mark. If the sealant is properly applied, it should not be absorbed into the bisque.

Insert Assembly for Finished Piece

Needless to say, work and conditions will vary. Not all slip formulas and glazes are the same. Consequently, the openings for the inserts will vary in diameter in the finished piece. To allow for these dimensional changes, the inserts are made of an oversized resilient material that will compress when they are pressed into the openings. The exit nozzle insert may require some wetting of the surface to help it slide into place. To remove the nozzle insert, push it through with a pencil, into the cavity. The insert seal can then be pried out with the fingers.

I claim:

1. A handheld drinking fountain comprising:

a main body having a body cavity and an upper opening for water entry into said body cavity;

an upward directed spout projecting outward from said body, said spout being in fluid communication with said body cavity for water export from said cavity; and a repositionable upper opening insert having an inlet orifice and adapted to be seated in said upper opening, said upper opening insert having a longitudinal axis, said upper opening insert having a flat-surfaced aerator contacting area which defines a contacting plane, said contacting plane being in angled relationship with a plane perpendicular to said longitudinal axis.

2. A handheld drinking fountain according to claim 1, wherein said angle relationship is at least about 7°.

3.A handheld drinking fountain according to claim 1, wherein said upper opening insert is engageable with said upper opening with a friction fit.

4. A handheld drinking fountain according to claim 1, wherein said inlet orifice is located in the center of said aerator contacting area.

5. A handheld drinking fountain according to claim 1, wherein said inlet orifice is centered between the center and the periphery of said aerator contacting area.

6. A handheld drinking fountain according to claim 1, the main body having a retaining shoulder projecting inward adjacent the upper opening, the shoulder adapted to guide the upper opening insert on installation of the insert into the upper opening and to prevent the insert from slipping down into the cavity by pressure from a faucet.

7. A handheld drinking fountain according to claim 1, wherein the main body has an essentially globular shape.

8. A handheld drinking fountain according to claim 6, wherein the upper opening insert further comprises an annular ridge adapted to rest upon the shoulder for an essentially watertight seal between the insert and the main body.

9. A handheld drinking fountain according to claim 1, further comprising a means for guiding the fountain against a faucet aerator, said means associated with the contacting area of the upper opening insert.

10. A handheld drinking fountain according to claim 9, wherein the means for guiding the fountain against a faucet aerator comprises a peripheral upright ring surrounding the aerator contacting area to guide the fountain against a faucet aerator.

11. A handheld drinking fountain comprising a main body having a body cavity and an upper opening for water entry into said body cavity, an upward directed spout projecting outward from said body, said spout being in fluid communication with said body cavity for water export from said cavity, said spout being lined with a plurality of longitudinal grooves.

12. A handheld drinking fountain according to claim 11, said spout being lined with said plurality of longitudinal grooves by means of a removable insert having a throat lined with said plurality of longitudinal grooves.

13. A handheld drinking fountain according to claim 11, said plurality of longitudinal grooves being six rounded grooves.

14. A handheld drinking fountain according to claim 1, wherein the fountain is constructed of a material comprising a ceramic material.

15. A handheld drinking fountain according to claim 14, wherein the ceramic further comprises a glaze material comprising a food-safe, lead-free glaze.

16. A handheld drinking fountain according to claim 1, wherein the fountain is constructed of a material selected from the group consisting of plastic, acrylic, melamine, polyester, phenolic, glass, ferrous materials, aluminum, rubber and wood.

17. A handheld drinking fountain according to claim 1, wherein the fountain is constructed of a material comprising an elastomeric polymer.

18. A handheld drinking fountain according to claim 12, wherein the spout insert is constructed of a material selected from the group consisting of pliable plastic, rubber, polyvinyl chloride, tygon, and silicone.

* * * * *